United States Patent [19]

DuRoss et al.

[11] 4,343,557

[45] Aug. 10, 1982

[54] SPACEBAR TOUCH CONTROL APPARATUS

[75] Inventors: Robert M. DuRoss, Huntsville, Ala.; Robert J. Stuhler, Mattydale, N.Y.

[73] Assignee: SCM Corporation, New York, N.Y.

[21] Appl. No.: 225,271

[22] Filed: Jan. 15, 1981

[51] Int. Cl.[3] ..... B41J 5/28

[52] U.S. Cl. ..... 400/496; 400/321; 400/325; 400/481

[58] Field of Search ..... 400/496, 325, 321, 481

[56] References Cited

U.S. PATENT DOCUMENTS

| | | | |
|---|---|---|---|
| 2,896,767 | 7/1959 | Barkdoll | 400/325 |
| 3,212,616 | 10/1965 | Frechette et al. | 400/325 |
| 3,771,636 | 11/1973 | Kerns, Jr. | 400/481 X |
| 4,269,521 | 5/1981 | Longrod | 400/496 X |

*Primary Examiner*—Paul T. Sewell

*Assistant Examiner*—Daniel J. Roock

*Attorney, Agent, or Firm*—William E. Mear, III; Ernest F. Weinberger

[57] ABSTRACT

A typewriter space bar touch control apparatus comprises a bell crank member, mounted on a support frame, which supports the space bar and a lever member which engages the bell crank when the space bar is depressed more than a small initial displacement. The motion of the bell crank is resisted by a helical tension spring and the engagement of the bell crank by the lever causes an operator to sense a sudden increase in resistance to displacement. Position transducers are provided on the support frame to sense the position of the lever member and the initial small displacement of the space bar corresponds to single space operation and larger displacement corresponds to repeat space operation.

16 Claims, 5 Drawing Figures

SPACEBAR TOUCH CONTROL APPARATUS

BACKGROUND OF THE INVENTION

Electric typewriters generally include provisions for both single and repeat spacing and consequently there is a need for a device which will enable an operator to easily distinguish between actuation of the space bar for single spacing as opposed to repeat spacing. With the advent of ever increasing labor and material costs, this device must combine: ease of manufacture and assembly, for low initial cost, with high reliability and ease of maintenance for low cost of ownership. These requirements rule out the use of complex mechanisms which require close tolerances and careful adjustments during assembly.

The prior art related to electric typewriters includes examples of various devices for enabling an operator to distinguish between single and repeat spacing. Examples of such devices may be found in U.S. Pat. No. 2,896,767 to J. P. Barkdoll and U.S. Pat. No. 3,212,616 to L. P. Frechette et al. The devices shown in these patents are each characterized by the use of a first spring which resists the downward motion of a space bar, for single spacing, and a relatively complex linkage mechanism which incorporates a second spring for increased resistance to motion of the space bar, for repeat spacing. The disadvantages of these devices are directly related to their overall complexity and the relatively large number of component parts which are required for operation. The relatively large number of component parts results in a relatively high cost of ownership which is caused by the greater incidence of wear and fatigue problems on the various links, springs and pivots. The complexity of these devices makes it relatively difficult and costly to repair these devices and difficult even to perform routine maintenance adjustment and cleaning operations.

OBJECTS OF THE INVENTION

It is an object of the present invention to provide a relatively simple and highly reliable apparatus for deciphering the actuation of a space bar for single and for repeat spacing.

Another object of the present invention is to provide a space bar touch control apparatus which is relatively simple in operation and rugged in construction.

Another object of the present invention is to provide a space bar touch control apparatus which utilizes a single spring member.

Still another object of the present invention is to provide a space bar touch control apparatus which comprises a relatively small number of component parts which are economical of manufacture and which can be manufactured in volume at a relatively low unit cost.

SUMMARY OF THE INVENTION

In accordance with the present invention there is provided a space bar touch control apparatus which may be used with either manual or electric typewriters and which comprises at least one lever member which is pivotally mounted on the support frame of the typewriter, with an end portion of the lever supporting the space bar. A bell crank member is also pivotally mounted on the support frame and has an end portion disposed proximate to the end portion of the lever. Depression of the space bar by an operator causes the lever to pivot and causes the end portion of the lever to bear against and force the bell crank member to pivot. The pivoting of the bell crank is resisted by a tension spring which connects a second end portion of the bell crank member to the support frame. Further depression of the space bar causes additional pivoting of the lever and brings a stud member which is mounted on the lever to bear against an intermediate portion of the bell crank member which is located at a radius shorter than the radius of the end portion which is originally in contact with the lever. The application of the force on the bell crank at a shorter radius results in a decrease in leverage on mechanical advantage and an increase in resistance which is sensed by the operator. Thus for relatively small displacements of the space bar, which correspond to single spacing of the typewriter, the operator senses a relatively small resistance, while for relatively larger displacements of the space bar, which correspond to repeat spacing of the typewriter, the operator senses a relatively large resistance. This difference in resistance enables an operator to easily distinguish between single and repeat spacing. The apparatus according to the present invention thus accomplishes its objects with extreme economy and simplicity of component parts.

In an alternative embodiment of the invention, for use with electric typewriters, an interposer member is pivotally mounted on the support frame of the typewriter, and is actuated by the lever member, which supports the space bar. An elongated leaf spring projects from the interposer member and the free end of the leaf spring is normally held by a permanent magnet which is mounted on the support frame. Initial depression of the space bar adds tension to the leaf spring and continued depression of the space bar adds sufficient tension to cause the free end of the leaf spring to be lifted off the permanent magnet and to strike a toothed member for generation of an electronic signal which activates the typewriter carrier to effect a single spacing of the carrier.

For repeat spacing, the operator further depresses the space bar and an abutment member on the lever acts to pivot a bail member, when the lever has been sufficiently pivoted. The bail member has a finger portion which actuates a switch which sends a signal to electronic control components of the typewriter in order to hold the electronic signal which had been previously generated for a single spacing of the carrier. As long as the operator continues to hold the space bar in the depressed repeat position, the switch continues to cause the electronic signal to be held and the carrier continues in the repeat spacing mode. When the operator releases the space bar the tension spring restores the bell crank member and the space bar to their original positions and the free end of the leaf spring is again held by the permanent magnet.

DESCRIPTION OF THE DRAWINGS

Additional objects and advantages of the present invention will become apparent during the course of the following specification when taken in connection with the accompanying drawings in which.

DETAILED DESCRIPTION OF THE INVENTION

Figure 1:
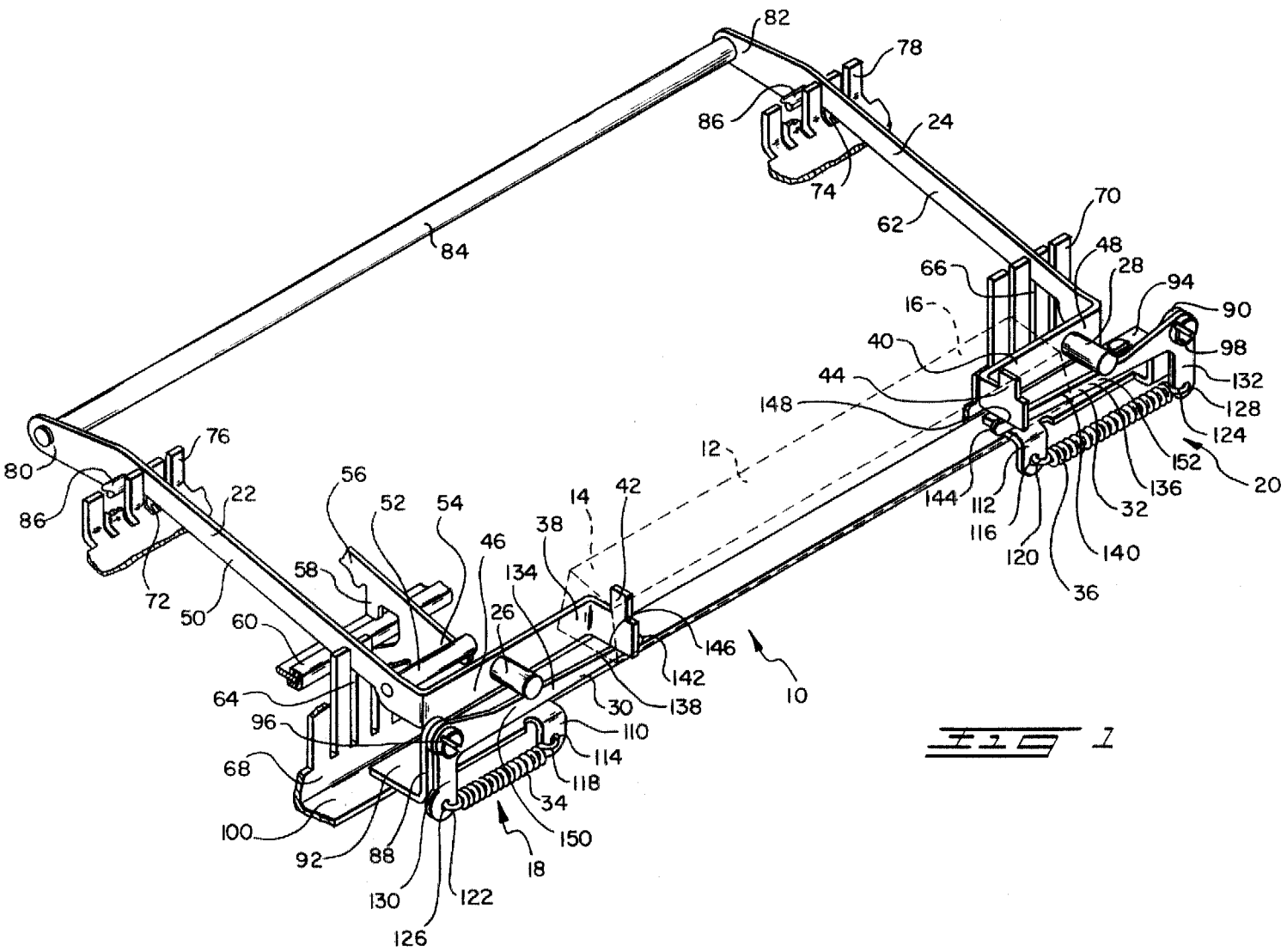
FIG. 1 is an overall perspective view of a space bar touch control apparatus, according to the present invention, with the space bar shown in broken lines.

With reference to the drawings, FIG. 1 shows a space bar touch control apparatus in accordance with the present invention, generally denoted by the reference numeral 10. The apparatus 10 comprises a space bar 12 which is shown in broken lines and which is supported at each end 14, 16 by a resistance sensor mechanism 18, 20. The two resistor sensor mechanisms 18, 20 are symmetrical. The resistance sensor mechanisms 18, 20 each include a lever 22, 24 which supports an end 14, 16 of the space bar 12 and a projecting stud 26, 28. The resistance sensor mechanisms 18, 20 also include the bell cranks 30, 32 and the helical tension springs 34, 36.

The ends 38, 40 of the levers 22, 24 include the formed ears 42, 44 on which the space bar 12 is mounted. The studs 26, 28 are mounted in the front portions 46, 48 of the levers 22, 24 and the studs 26, 28 project in the forward direction. The side portion 50 of the lever 22 includes an inwardly directed stud 52 which engages the ear portion 54 of the interposer member 56. The interposer member 56 also includes a leg portion 58 which engages the stop member 60 when the space bar 12 is fully depressed.

The sides 50, 62 of the levers 22, 24 extend through the slots 64, 66 in the front guide members 68, 70 and through the slots 72, 74 in the rear guide members 76, 78 and the ends 80, 82 of the levers 22, 24 are connected by a shaft 84 which maintains equal depression of the space bar 12 from side to side. The levers 22, 24 are each pivotally mounted on the shaft 86.

Figure 2:
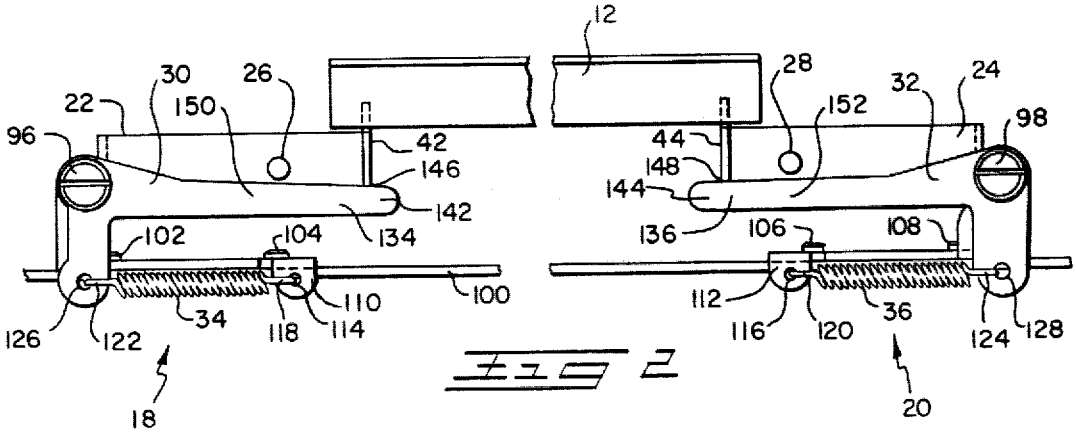
FIG. 2 is a front elevation view of the apparatus of FIG. 1 with the apparatus shown in an unstressed condition with no pressure on the space bar.
Figure 3:
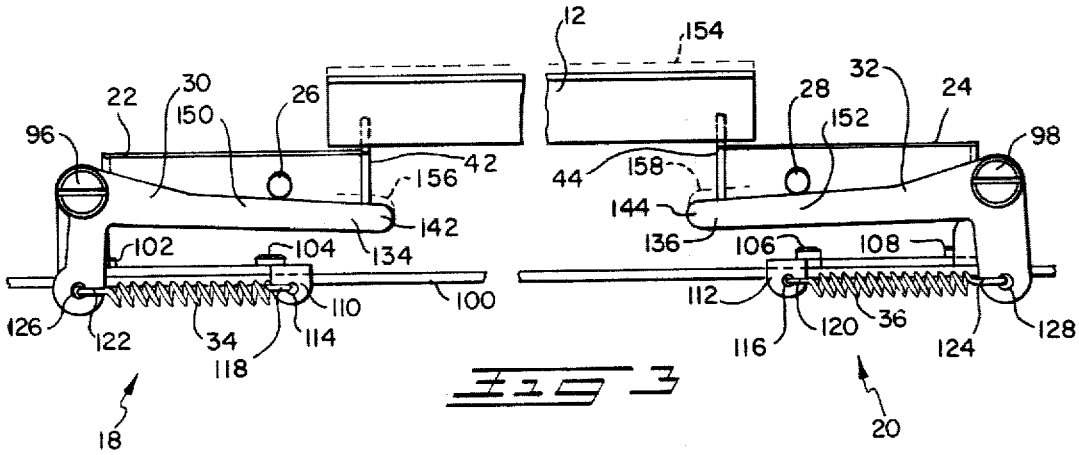
FIG. 3 is a front elevation view of the apparatus, similar to FIG. 2, showing the configuration of the elements of the apparatus when the space bar is subjected to a slight pressure, and showing the original unstressed position of the elements of the apparatus in broken lines.
Figure 4:
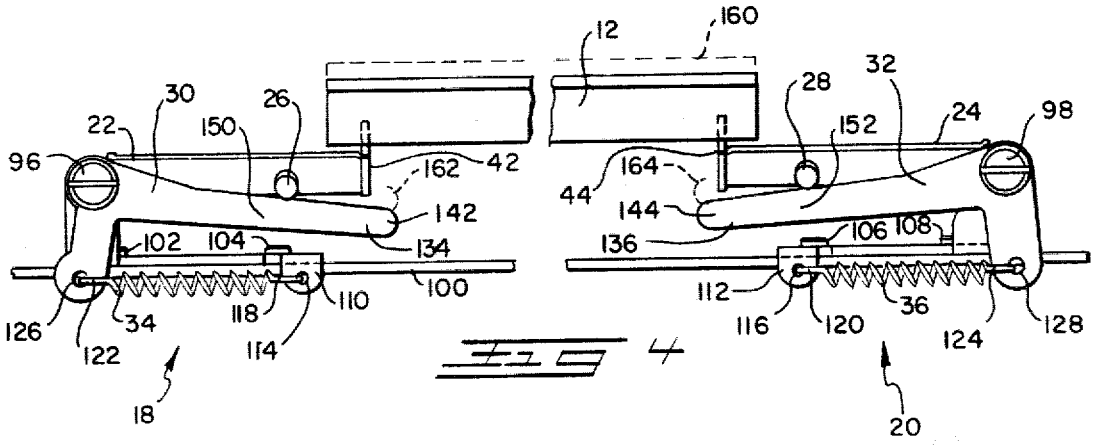
FIG. 4 is a front elevation view of the apparatus, similar to FIG. 3, showing the configuration of the elements of the apparatus when the space bar is subjected to a heavier pressure and showing the original unstressed position of the elements of the apparatus in broken lines.

The bell cranks 30, 32 are pivotally connected to the upright flanges 88, 90 of the brackets 92, 94 by the pivots 96, 98. The brackets 92, 94 are mounted on the support plate 100 by the screws 102, 104, 106, 108 as shown in FIGS. 2–4. Each of the brackets 92, 94 includes a vertical tab 110, 112 which has a hole 114, 116 through which the first hooks 118, 120 of the helical tension springs 34, 36 are mounted. The second hooks 122, 124 of the helical tension springs 34, 36 are mounted in the holes 126, 128 of vertical arms 130, 132 of the bell cranks 30, 32. The horizontal arms 134, 136 of the bell cranks 30, 32 each have an upper edge 138, 140, the end portions 142, 144 of which engage the lower edges 146, 148 of the ears 42, 44 of the levers 22, 24. An intermediate portion 150, 152 of the arms 134, 136 of the bell cranks 30, 32 engages the studs 26, 28 on the levers 22, 24 in a manner which will be presently described.

The operation of the apparatus 10 according to the present invention will now be described with reference to FIGS. 2–4. The configuration of the component parts of the apparatus 10 when the apparatus 10 is in the unstressed state is shown in FIG. 2. In this state the lower edges 146, 148 of the ears 42, 44 of the levers 22, 24 engage the end portions 142, 144 of the bell crank arms 134, 136. The studs 26, 28 on the levers 22, 24 are spaced slightly above the intermediate portion 150, 152 of the bell crank arms 134, 136. In this state, there is little or no force on the helical tension springs 34, 36 and the coils of these springs are in their normal unstressed condition with the coils in contact with each other.

For a single space operation of the apparatus 10, the operator depresses the space bar 12 slightly as is shown in FIG. 3. The original position of the space bar 12 is indicated by the broken lines 154. The depression of the space bar 12 causes the levers 22, 24 to pivot about the shaft 86 and the ears 42, 44 of the levers 22, 24 cause the arms 134, 136 of the bell cranks 30, 32 to pivot against the urging of the helical tension springs 34, 36 which offer relatively little resistance. The original positions of the ends 142, 144 of the bell crank arms 134, 136 are indicated by the broken lines 156, 158. In the configuration of the apparatus 10 shown in FIG. 2 the depression of the space bar 12 causes the studs 26, 28 to just touch the intermediate portions 150, 152 of the bell crank arms 134, 136.

For repeat spacing the operator further depresses the space bar 12 as is shown in FIG. 4. The original positions of the space bar 12 and the bell crank arms 134, 136 are indicated by the broken lines 160, 162, 164. This further depression of the space bar 12 causes the levers 22, 24 to pivot further, allowing the studs 26, 28 to come in full contact with the intermediate portions 150, 152 of the bell crank arms 134, 136 resulting in increased resistance due to the shorter pivoting radius of the bell crank arms.

As a result, an operator will feel a slight resistance when the space bar 12 is depressed for single spacing and a significantly greater resistance when the space bar 12 is depressed further for repeat spacing. This difference in resistance enables an operator to efficiently and unerringly control the space bar 12 in accordance with the desired spacing.

When the space bar 12 is released by the operator, the springs 34, 36 will return the space bar 12 upward to the unactuated position.

Two resistance sensors 18, 20 have been shown in the embodiment of the invention shown in FIGS. 1–4, and described above. An alternative embodiment of the invention, which is not shown, utilizes a single resistance sensor. The operation of this resistance sensor and the various components of the alternative apparatus are identical to that which has been described.

Figure 5:
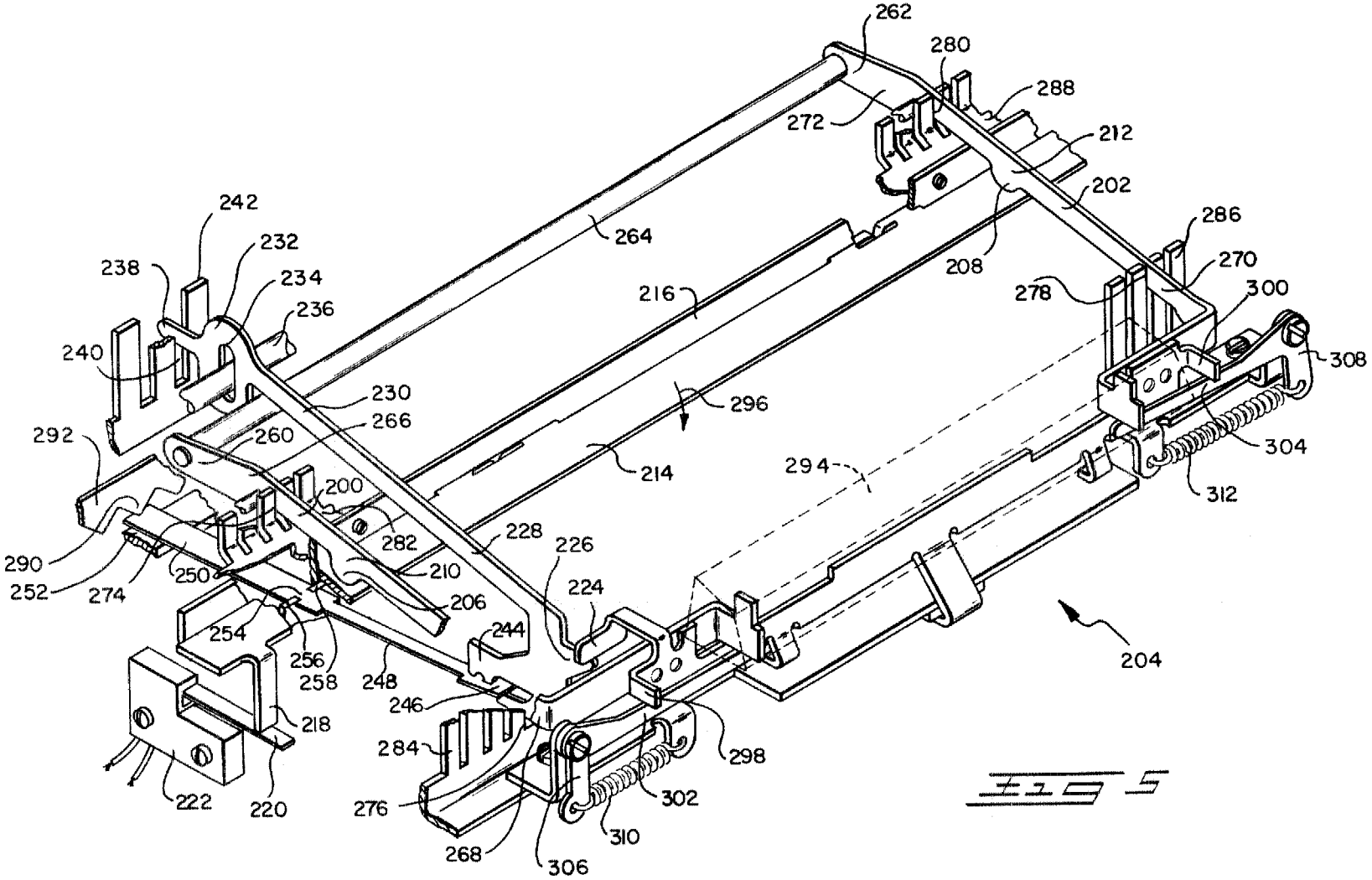
FIG. 5 is an overall perspective view of the space bar touch control apparatus, similar to FIG. 1, showing additional components which transfer the output of the space bar touch control apparatus to various operating portions of an electric typewriter.

The output of the space bar touch control apparatus 10 of FIG. 1 may be transferred to the various operating portions of a mechanical or an electric typewriter through a variety of mechanical or electromechanical transfer devices. A preferred arrangement for transfer of the output of the space bar touch control apparatus 10 to an electric typewriter is shown in FIG. 5. The levers 200, 202 of the device 204, shown in FIG. 5 are generally similar to the levers 22, 24 shown in FIG. 1 with the exception that a pair of abutment portions 206, 208 have been provided on intermediate portions 210, 212 of the levers. The abutment portions 206, 208 bear against and are capable of rotating a bail member 214 which is pivotally mounted on a rigidly supported bracket 216 which is attached to the frame of the typewriter, which is not shown. The bail member 214 includes a downwardly projecting finger member 218 which bears against the operating lever 220 of the electrical switch 222.

With continued reference to FIG. 5 the lever 200 includes an arm member 204 which bears against the end 226 of the interposer member 228. The interposer member 228 includes an arm portion 230, the end 232 of which includes a slotted portion 234, which is pivotally mounted on a shaft 236. A projecting finger 238 on the end 232 of the arm 230 is guided by the slot 240 on the bracket 242. The interposer member 228 includes a downwardly projecting portion 244 on which there is mounted the end 246 of a leaf spring 248, which is made of a suitable magnetic material. The free end 250 of the leaf spring 248 is held, in the unactuated position, by a permanent magnet 252 which is rigidly connected to the frame of the typewriter by a structure which is not shown. An intermediate portion 254 of the leaf spring 248 is capable of pivoting about the spring support members 256, 258 which are mounted on the bracket 216.

The ends 260, 262 of the levers 200, 202 are connected by a shaft 264 and intermediate portions 266, 268, 270, 272 of the levers 200, 202 are guided by slotted 274, 276, 278, 280 portions of the brackets 282, 284, 286, 288, which are connected to the support frame of the typewriter, which is not shown.

Downward motion of the end 246 of the leaf spring 248 by the interposer member 228 initially adds tension to the leaf spring 248 and the free end 250 of the leaf spring 248 remains in contact with the permanent magnet 252. Further downward motion of the interposer 228 causes sufficient tension to cause the free end 250 to be lifted off the permanent magnet 252. The free end 250 then has a snap-action motion caused by pivoting about the spring support members 256, 258. The snap-action motion causes the free end 250 to move upward and strike a tooth 290 on a bar 292 which is connected to electronic code generation device, which is not shown, for generation of an electronic signal for single spacing of the typewriter carrier.

For repeat spacing, continued pressure on the space bar 294 causes the abutment portions 206, 208 to pivot the bail member 214 in a clockwise direction as indicated by the arrow 296 in FIG. 5. The finger member 218 bears against the switch lever 220 to actuate the switch 222. The actuated switch 222 sends a signal to the electronic components of the typewriter to hold the code, which is generated by the single space operation, and to repeat the same code for repeat spacing of the carrier for as long as the space bar 294 is held in the depressed repeat position by the operator.

When the space bar 294 is depressed for repeat spacing, the arms 298, 300 which are mounted on the levers 200, 202 come into contact with intermediate portions 302, 304 of the bell crank members 306, 308 and the operator feels increased resistance in a manner which has been previously described.

When the space bar 294 is released by the operator, the springs 310, 312 pull the space bar 294 upward to the unactuated position and the free end 250 of the leaf spring 248 is again held by the permanent magnet 252 and the device 204 of FIG. 5 is again ready for the next actuation.

While preferred embodiments of the invention have been shown and described herein, it is obvious that numerous additions, changes and omissions may be made in such embodiments without departing from the spirit and scope of the invention.

What is claimed is:

1. A typewriter space bar touch control apparatus comprising:

support frame means;

a pivoting member pivotally mounted on said support frame means and having a support portion;

spring means connecting said pivoting member and said support frame means and disposed to resist pivoting motion of said pivoting member;

space bar means supported by said support portion of said pivoting member, with initial motion of said space bar resisted by said spring means;

an engagement member mounted on said space bar means for motion with said space bar means and with said engagement member engaging an intermediate portion of said pivoting member, having a pivot radius less than that of said support portion, responsive to motion of said space bar beyond said initial motion for causing an abrupt increase in the rate of resistance to further motion of said space bar.

2. An apparatus according to claim 1 in which said pivoting member comprises a bell crank.

3. An apparatus according to claim 1 in which said spring means comprises a helical tension spring.

4. An apparatus according to claim 1 further comprising position transducer means mounted on said support frame and disposed to provide an electrical signal responsive to the position of said engagement member.

5. An apparatus according to claim 1 further comprising position sensing means mounted on said support frame and disposed to sense the position of said engagement member, control signal means, mounted on said support frame and disposed to generate an electrical control signal, responsive to said position sensing means, for control of single and repeat spacing functions of said typewriter.

6. An apparatus according to claim 5 in which said position sensing means comprises an elongated interposer member pivotally mounted on said support frame having a first end and a second end, with said first end disposed bearing against said pivoting member for motion of said interposer member responsive to pivoting of said pivoting member, electrical signal generation means mounted on said support frame, and with said second end of said interposer member having a portion disposed proximate to said electrical signal generation means for generation of an electrical signal responsive to motion of said pivoting member.

7. An apparatus according to claim 4 in which said position transducer means comprises first transducer means disposed to provide an electrical signal responsive to initial relatively small displacements of said space bar and second transducer means disposed to provide an electrical signal responsive to increased displacement of said space bar means.

8. An apparatus according to claim 7 in which said first transducer means comprises a leaf spring mounted on said support frame and coupled for movement by said space bar means, a permanent magnet member mounted on said support frame disposed adjacent to said leaf spring to hold said leaf spring in an unactuated position, electrical signal generation means mounted on said support frame adjacent to said leaf spring with said leaf spring flexing away from said permanent magnet member to actuate said electrical signal generation means, responsive to initial motion of said space bar means.

9. An apparatus according to claim 8 in which said second transducer means comprises electrical switch means mounted on said support frame, an actuating member mounted on said support frame for actuation of said electrical switch means responsive to displacement of said space bar means greater than said initial displacement.

10. A typewriter space bar touch control apparatus comprising a support frame, bell crank means, pivotally mounted on said support frame, with said bell crank means having a first end portion, a second end portion and an intermediate portion disposed between said pivotal mounting and said first end portion, spring means connecting said second end of said bell crank means and said support frame, a lever member pivotally mounted on said support frame having an intermediate portion disposed proximate to said bell crank means, and having an end portion disposed bearing against said first end portion of said bell crank means, a space bar member supported by said end portion of said lever member, abutment means, mounted on said intermediate portion of said lever member and disposed projecting over said intermediate portion of said bell crank member and normally spaced away from said intermediate portion of said bell crank with initial depression of said space bar member causing pivoting of said lever member and said bell crank means against resistance of said spring means and with further depression of said space bar member causing engagement of said abutment means on said lever member and said intermediate portion of said bell crank means and increased resistance to further depression of said space bar member.

11. An apparatus according to claim 10 in which said abutment means comprises a stud member projecting from said intermediate portion of said lever member.

12. An apparatus according to claim 10 in which said bell crank comprises a pair of angularly disposed end portions.

13. An apparatus according to claim 12 in which said pair of angularly disposed end portions are generally perpendicular to each other.

14. An apparatus according to claim 10 in which said spring means comprises a helical tension spring.

15. A typewriter space bar touch control apparatus comprising a support frame, a pair of sensing means mounted on said support frame, an elongated space bar member having a pair of opposite ends, each supported by one of said pair of sensing means and with each of said sensing means comprising bell crank means pivotally mounted on said support frame, with each of said bell crank means having a first end portion, a second end portion and an intermediate portion disposed between said pivotal mounting and said first end portion, spring means connecting said second ends of said bell crank means and said support frame, a lever member, pivotally mounted on said support frame, each having an intermediate portion disposed proximate to said bell crank means, and each having an end portion disposed bearing against said first end portions of said bell crank means, with said space bar member supported by said end portions of said lever members, abutment means, mounted on each of said intermediate portions of said lever members and disposed projecting over said intermediate portions of said bell crank members and normally spaced away from said intermediate portions of said bell crank members with initial depression of said space bar member causing pivoting of said lever members and said bell crank means against resistance of said spring means and with further depression of said space bar member causing engagement of said abutment means on said lever members and said intermediate portions of said bell cranks means and increased resistance to further depression of said space bar member.

16. An apparatus according to claim 15 in which each said lever members have a second end portion and further comprising a shaft connecting said second end portions of said lever members.

* * * * *